US010797401B2

(12) United States Patent
Takikawa et al.

(10) Patent No.: US 10,797,401 B2
(45) Date of Patent: Oct. 6, 2020

(54) REFLECTION MIRROR ANTENNA DEVICE

(71) Applicant: MITSUBISHI ELECTRIC CORPORATION, Tokyo (JP)

(72) Inventors: Michio Takikawa, Tokyo (JP); Shinichi Yamamoto, Tokyo (JP); Takashi Tomura, Tokyo (JP); Yoshio Inasawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/342,765

(22) PCT Filed: Dec. 13, 2016

(86) PCT No.: PCT/JP2016/087041
§ 371 (c)(1),
(2) Date: Apr. 17, 2019

(87) PCT Pub. No.: WO2018/109837
PCT Pub. Date: Jun. 21, 2018

(65) Prior Publication Data

US 2019/0296445 A1 Sep. 26, 2019

(51) Int. Cl.
*H01Q 15/16* (2006.01)
*H01Q 15/00* (2006.01)
(Continued)

(52) U.S. Cl.
CPC ..... *H01Q 15/16* (2013.01); *H01Q 5/28* (2015.01); *H01Q 5/45* (2015.01);
(Continued)

(58) Field of Classification Search
CPC ..... H01Q 15/02; H01Q 15/24; H01Q 15/16; H01Q 15/0006; H01Q 15/0013;
(Continued)

(56) References Cited

U.S. PATENT DOCUMENTS 6,054,967 A * 4/2000 Wu ..... H01Q 15/02 343/700 MS
6,169,524 B1 * 1/2001 Wu ..... H01Q 1/288 343/840
(Continued)

FOREIGN PATENT DOCUMENTS

EP 0 982 800 A2 3/2000
JP 59-44108 A 3/1984
(Continued)

OTHER PUBLICATIONS

De Souza et al., "Fullwave Analysis of Reflectarrays on Double Iso/Anisotropic Layers", International Telecommunications Symposium Proceedings, 2006, pp. 452-455.
(Continued)

*Primary Examiner* — Seokjin Kim
(74) *Attorney, Agent, or Firm* — Birch, Stewart, Kolasch & Birch, LLP

(57) ABSTRACT

A first region of a reflection mirror including a center point of the paraboloid of revolution is formed of a conductor. A second region, which is an outer peripheral side of the first region, of the reflection mirror is a region where a plurality of reflection elements, which are conductor patterns, is arranged on a dielectric body overlaid on a base plate conductor. An arrangement pitch of the plurality of reflection elements corresponds to a wavelength of a radio wave in the second frequency band.

4 Claims, 9 Drawing Sheets

(51) Int. Cl.

| | |
|---|---|
| ***H01Q 19/18*** | (2006.01) |
| ***H01Q 19/17*** | (2006.01) |
| ***H01Q 5/45*** | (2015.01) |
| ***H01Q 19/13*** | (2006.01) |
| ***H01Q 5/28*** | (2015.01) |

(52) U.S. Cl.
CPC ..... *H01Q 15/0013* (2013.01); *H01Q 15/0033* (2013.01); *H01Q 19/13* (2013.01); *H01Q 19/17* (2013.01); *H01Q 19/18* (2013.01)

(58) Field of Classification Search
CPC .. H01Q 15/0026; H01Q 15/0033; H01Q 5/28; H01Q 5/45; H01Q 19/13; H01Q 19/17; H01Q 19/18; H01Q 19/195; H01Q 1/288; H01Q 25/007
See application file for complete search history.

(56) References Cited

U.S. PATENT DOCUMENTS

| | | | | |
|---|---|---|---|---|
| 6,608,607 | B2 * | 8/2003 | Wu ..... | H01Q 19/13 343/781 R |
| 7,737,903 | B1 | 6/2010 | Rao et al. | |
| 2005/0219146 | A1 | 10/2005 | Judasz et al. | |

FOREIGN PATENT DOCUMENTS

| | | | |
|---|---|---|---|
| JP | 3-154406 | A | 7/1991 |
| JP | 2000-91836 | A | 3/2000 |

OTHER PUBLICATIONS

Garcia-Vigueras et al., "Efficient network representation of grounded patch-based FSS", The 8th European Conference on Antennas and Propagation (EuCAP 2014), vol. 63, No. 2, pp. 1960-1963.
International Search Report (PCT/ISA/210) issued in PCT/JP2016/087041, dated Feb. 7, 2017.
Japenese Office Action for application No. 2017-518560 dated May 30, 2017.
Rao et al., "Advanced Antenna Technologies for Satellite Communications payloads", IEEE Transactions on Antennas and Propagation, Apr. 2015, vol. 63, No. 4, pp. 1205-1217.
Sakran et al., "Absorbing Frequency-Selective-Surface for the mm-Wave Range", IEEE Transactions on Antennas and Propagation, Aug. 2008, vol. 56, No. 8, pp. 2649-2655.
Zhou, et al., "Analysis and Optimization of a Curved Transmit-Receive Contoured Beam Reflectarray," 2015 9th European Conference on Antennas and Propagation (EUCAP), EURAAP, XP033212511, Apr. 13, 2015 (retrieved by EPO on Aug. 27, 2015), pp. 1-5.

* cited by examiner

REFLECTION MIRROR ANTENNA DEVICE

TECHNICAL FIELD

The present invention relates to a reflection mirror antenna device having a primary radiator and a reflection mirror.

BACKGROUND ART

For example, in a communication system used for satellite communication in the Ka band, which is the frequency band of 27 GHz to 40 GHz, in order to achieve large-capacity and high-speed communication, a system in which a desired coverage area is covered with a plurality of pencil beams has become a mainstream.

As communication bands in the Ka band, the transmission band is set at 20 GHz, and the reception band is set at 30 GHz, and thus a gap exists between the transmission band and the reception band.

For this reason, a reflection mirror antenna for both transmission and reception has different illuminance distributions of radio waves radiated from a primary radiator on a reflection mirror, and a beam width in the reception band is narrower than that in the transmission band. As a result, there arises a problem of difference between gain of a beam in the transmission band and gain of a beam in the reception band at ends of the desired coverage area.

The following Patent Literature 1 discloses a reflection mirror antenna that has a step on the mirror surface of a reflection mirror such that a phase at a center portion of the reflection mirror is different from a phase in an outer peripheral portion by 180 degrees in order to bring the gain of a beam in the transmission band and the gain of a beam in the reception band at ends of a desired coverage area as close as possible.

CITATION LIST

Patent Literatures

Patent Literature 1: U.S. Pat. No. 7,737,903 B1

SUMMARY OF INVENTION

Technical Problem

A conventional reflection mirror antenna device configured as described above can bring the gain of a beam in the transmission band and the gain of a beam in the reception band at ends of a desired coverage area close to each other. However, manufacturing a step on a mirror surface of a reflection mirror is difficult, and forming the step that meets design values is difficult, so that the gain of a beam in the reception band at the ends of the coverage area becomes lower than that in the transmission band at the ends of the coverage area in some cases.

As a result, there is a problem that, when the reflection mirror antenna device is used as a shared antenna serving as both of a transmission antenna and a reception antenna, even in a case where the gain of a beam in the transmission band at ends of the coverage area is high, communication characteristics of the reflection mirror antenna device is limited in accordance with the gain of the beam in the reception band.

The present invention is made to solve the above-described problem, and an object of the present invention is to achieve a reflection mirror antenna device capable of adjusting the gain of a beam in a transmission band and the gain of a beam in a reception band to coincide with each other at ends of a coverage area.

Solution to Problem

A reflection mirror antenna device according to the invention includes: at least one primary radiator radiating a radio wave in a first frequency band and a radio wave in a second frequency band higher than the first frequency band; and a reflection mirror having a surface of a paraboloid of revolution reflecting radio waves in the first and second frequency bands radiated from the at least one primary radiator. A first region of the reflection mirror including a center point of the paraboloid of revolution is formed of a conductor. A second region, which is an outer peripheral side of the first region, of the reflection mirror is a region where a plurality of reflection elements, which are conductor patterns, is arranged on a dielectric body overlaid on a base plate conductor. An arrangement pitch of the plurality of reflection elements corresponds to a wavelength of a radio wave in the second frequency band. The plurality of reflection elements arranged in the second region cause phase difference between a reflection phase of a radio wave on the first region and a reflection phase of a radio wave on the second region. The phase difference between a reflection phase of a radio wave at the center point included in the first region and a reflection phase of a radio wave on the second region is in a range between 90 and 180 degrees.

Advantageous Effects of Invention

According to the invention, a first region of the reflection mirror including a center point of the paraboloid of revolution is formed of a conductor. A second region, which is an outer peripheral side of the first region, of the reflection mirror is a region where a plurality of reflection elements, which are conductor patterns, is arranged on a dielectric body overlaid on a base plate conductor. An arrangement pitch of the plurality of reflection elements corresponds to a wavelength of a radio wave in the second frequency band. Thus, an effect of adjusting gain of a beam in a transmission band and gain of a beam in a reception band to coincide with each other at ends of a coverage area without forming a step on the mirror surface of the reflection mirror can be achieved.

DESCRIPTION OF EMBODIMENTS

In order to describe the present invention in more detail, some embodiments for carrying out the present invention will be described below with reference to the accompanying drawings.

First Embodiment

FIG. 1 is a configuration diagram illustrating a reflection mirror antenna device according to a first embodiment of the invention.

Figure 1B:
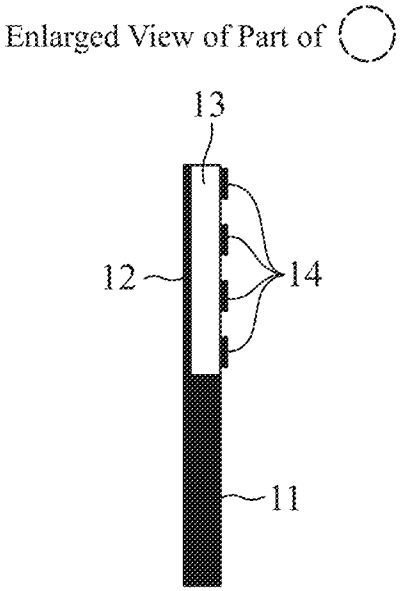
FIG. 1B is an enlarged view of a main portion surrounded by a dotted circle in FIG. 1A.
Figure 1A:
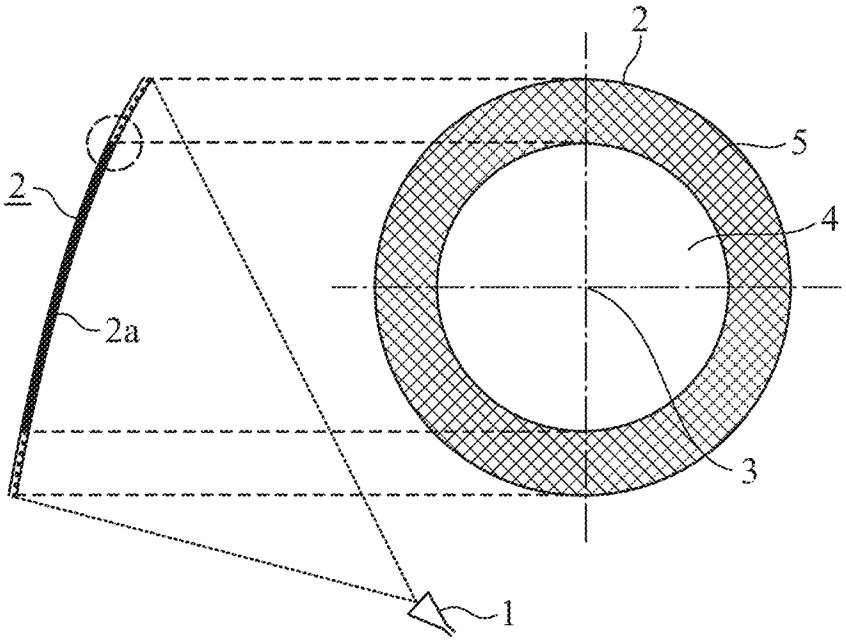
FIG. 1A is a configuration diagram illustrating a reflection mirror antenna device according to a first embodiment of the invention.

FIG. 1A is a configuration diagram illustrating the reflection mirror antenna device according to the first embodiment of the invention, and FIG. 1B is an enlarged view of a main portion surrounded by a dotted circle in FIG. 1A.

In FIG. 1, a primary radiator 1 radiates a radio wave in a first frequency band, and radiates a radio wave in a second frequency band which is higher than the first frequency band.

A reflection mirror 2 has a surface of a paraboloid of revolution 2*a* reflecting a radio wave in the first and second frequency bands radiated from the primary radiator 1.

A first region 4 includes a center point 3 of the paraboloid of revolution 2*a*, and is formed of a conductor 11.

A second region 5 is an outer peripheral side of the first region 4.

In the second region 5, a plurality of reflection elements 14, which are conductor patterns, respectively, is arranged on a dielectric body 13 overlaid on a base plate conductor 12.

The base plate conductor 12 is formed on the back side of the reflection mirror 2, the back side not receiving radio waves radiated from the primary radiator 1, and the reflection elements 14 are formed on the front side of the reflection mirror 2, the front side receiving radio waves radiated from the primary radiator 1.

N (N represents an integer of equal to or more than two) reflection elements 14 are arranged in the second region 5.

An arrangement pitch of the N reflection elements 14 corresponds to a wavelength of the radio wave in the second frequency band. For example, when the wavelength of the radio wave in the second frequency band is $\lambda$, the arrangement pitch of the N reflection elements 14 is in the range of approximately $0.5\times\lambda$ to $0.7\times\lambda$.

In the first embodiment, since the arrangement pitch of the N reflection elements 14 is designed to correspond to the wavelength of the radio wave in the second frequency band, the N reflection elements 14 influence phase distribution on the reflection mirror 2 in the second frequency band.

On the other hand, in the first frequency band lower than the second frequency band, the N reflection elements 14 merely act as conductors, and do not contribute to change in a reflection phase.

The N reflection elements 14 thus do not influence the phase distribution on the reflection mirror 2 in the first frequency band.

In the enlarged view of FIG. 1B, as seen in a macroscopic vision, the reflection mirror 2 is described in a plane. However, since the reflection mirror 2 is actually the paraboloid of revolution 2*a*, it has a curved surface.

In the first embodiment, the N reflection elements 14 arranged in the second region 5 cause the difference between a reflection phase of a radio wave on the first region 4 and a reflection phase of a radio wave on the second region 5, and the phase difference between a reflection phase of a radio wave at the center point 3 included in the first region 4 and the reflection phase of a radio wave on the second region 5 is in the range between 90 and 180 degrees.

Operations will now be described.

The primary radiator 1 radiates a radio wave in the first frequency band and a radio wave in the second frequency band.

The reflection mirror 2 has a surface of a paraboloid of revolution 2*a* reflecting radio waves in the first and second frequency bands radiated from the primary radiator 1, and reflects the radio waves in the first and second frequency bands radiated from the primary radiator 1 to a desired direction.

FIG. 2 is an explanatory diagram illustrating amplitude distribution and phase distribution on the reflection mirror in the reflection mirror antenna device.

Figure 2A:
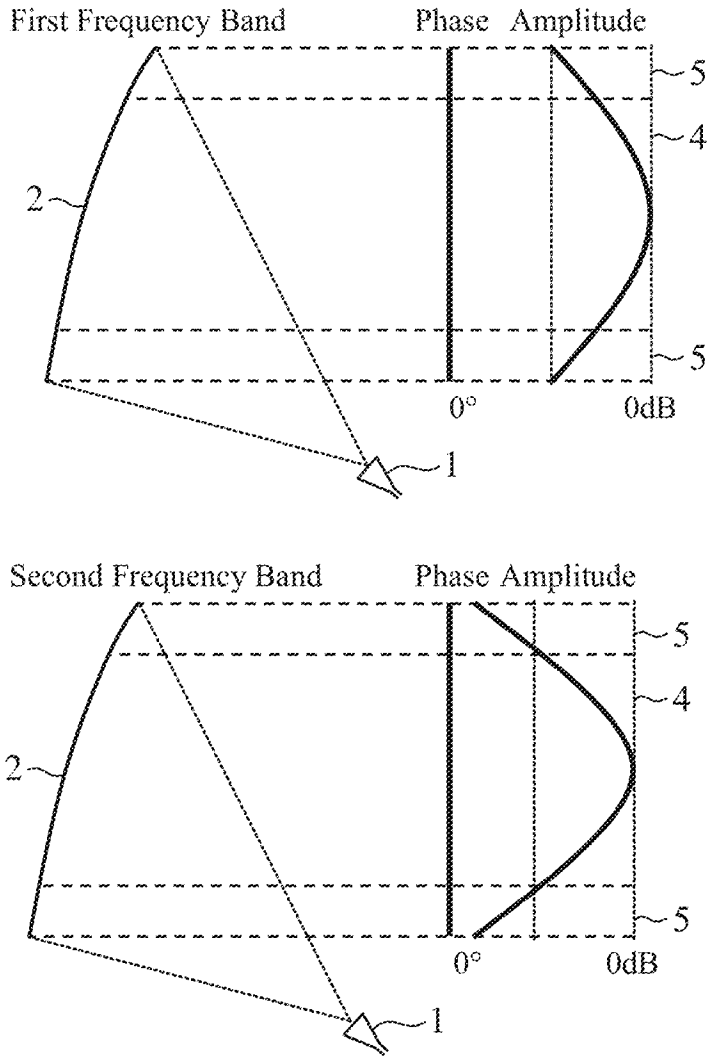
FIG. 2A is an explanatory diagram illustrating amplitude distribution and phase distribution on a reflection mirror in the reflection mirror antenna device, the entire reflection mirror being formed of a conductor.
Figure 2B:
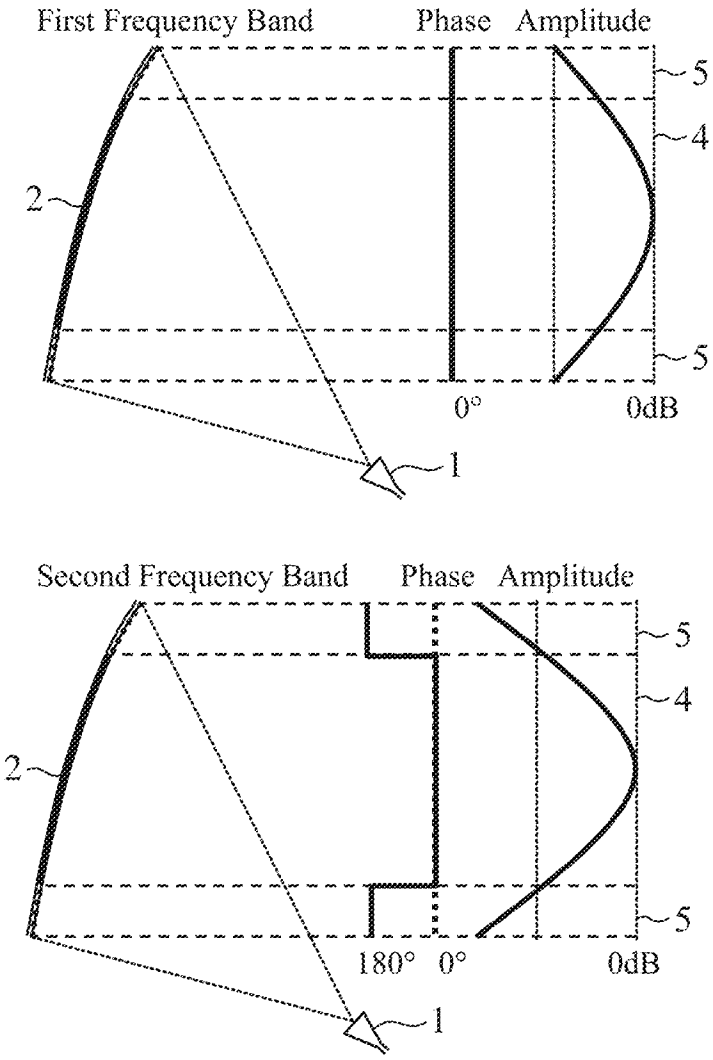
FIG. 2B is an explanatory diagram illustrating amplitude distribution and phase distribution on a reflection mirror in the reflection mirror antenna device in the first embodiment.

FIG. 2A illustrates amplitude distribution and phase distribution on the reflection mirror in the reflection mirror antenna device, the entire reflection mirror being formed of a conductor, and FIG. 2B illustrates amplitude distribution and phase distribution on the reflection mirror in the reflection mirror antenna device of the first embodiment.

In the reflection mirror antenna device whose reflection mirror 2 is entirely formed by a conductor, as illustrated in FIG. 2A, the amplitude distribution on the reflection mirror 2 in the first frequency band is different from that in the second frequency band.

On the other hand, as illustrated in FIG. 2A, by designing the primary radiator 1 appropriately, as illustrated in FIG. 2A, it is possible to adjust the phase distribution on the reflection mirror 2 in the first frequency band and that in the second frequency band to be approximately the same.

In such a design, the beam width of a beam, which is a radio wave reflected by the reflection mirror 2, in the first frequency band is narrower than that in the second frequency band. This is because tapering of the amplitude distribution on the reflection mirror 2 in the first frequency band is more moderate than that in the second frequency band since the first frequency band is lower than the second frequency band.

Since the beam width in the first frequency band is different from that in the second frequency band, when a desired coverage area is set, gain of a beam in the first frequency band is different from that in the second frequency band at ends of the coverage area.

In the reflection mirror antenna device of the first embodiment, the N reflection elements 14 arranged in the second region 5 cause the difference between the reflection phase of a radio wave on the first region 4 and the reflection phase of a radio wave on the second region 5.

In the example of FIG. 2B, the phase difference between the reflection phase of a radio wave at the center point 3 included in the first region 4 and the reflection phase of a radio wave on the second region 5 is 180 degrees.

Thus, synthesis of the beam reflected by the first region 4 and the beam reflected by the second region 5 can adjust the gain of the beam in the first frequency band and the gain of the beam in the second frequency band to coincide with each other at ends of the coverage area.

Figure 3:
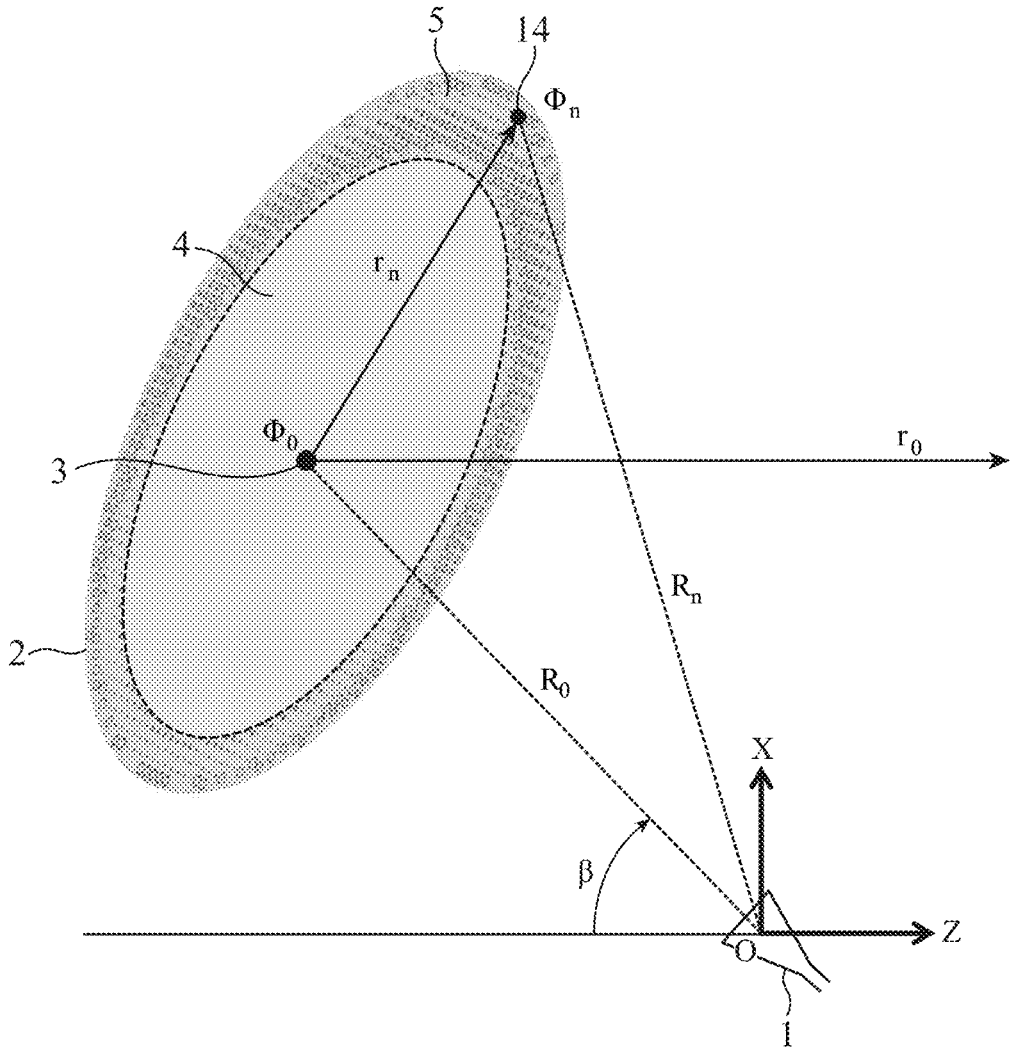
FIG. 3 is an explanatory diagram for explaining a means for determining a reflection phase on a second region 5.

Here, FIG. 3 is an explanatory diagram illustrating a means for determining the reflection phase on the second region 5.

In FIG. 3, the phase center of the primary radiator 1 is defined as the origin O of an orthogonal coordinate system.

$r_0$ is a unit vector representing a main beam direction of the reflection mirror 2. The primary radiator 1 is inclined at an offset angle β with respect to the reflection mirror 2 having the paraboloid of revolution 2*a*.

The distance from the origin O to the center point 3 of the paraboloid of revolution 2*a* is represented as a distance $R_0$, and the reflection phase at the center point 3 of the paraboloid of revolution 2*a* is represented as $\Phi_0$.

The distance $R_0$ can be expressed by the following expression (1).

$$R_0 = \frac{2f}{1+\cos\beta} \tag{1}$$

In the expression (1), f represents the focal distance of the reflection mirror 2.

In addition, the reflection phase $\Phi_0$ at the center point 3 of the paraboloid of revolution 2*a* can be expressed by the following expression (2).

$$\Phi_0 = k_0 R_0 \tag{2}$$

In the expression (2), $k_0$ represents a wave number (=2π/wavelength).

In addition, in FIG. 3, a reflection phase at a position where the n (n=1, 2, . . . , and N)-th reflection element 14, among the N reflection elements 14 arranged in the second region 5, is arranged is represented as $\Phi_n$, and the distance from the origin O to the n-th reflection element 14 is represented as $R_n$. $r_n$ is a position vector pointing the reflection phase $\Phi_n$ from the reflection phase $\Phi_0$.

The reflection phase $\Phi_n$ at the position where the n-th reflection element 14 is arranged can be expressed by the following expression (3).

$$\Phi_n = k_0(R_n - r_n \cdot r_0) \tag{3}$$

Consequently, it is possible to set the phase difference between the reflection phase of a radio wave at the center point 3 and the reflection phase of a radio wave at the position where the n-th reflection element 14 is arranged in the range between 90 and 180 degrees, by setting the reflection phase $\Phi_n$ as in the expression (4) by using the expressions (2) and (3).

$$\frac{\pi}{2} \le |\Phi_n - \Phi_0| \le \pi \tag{4}$$

Figure 4:
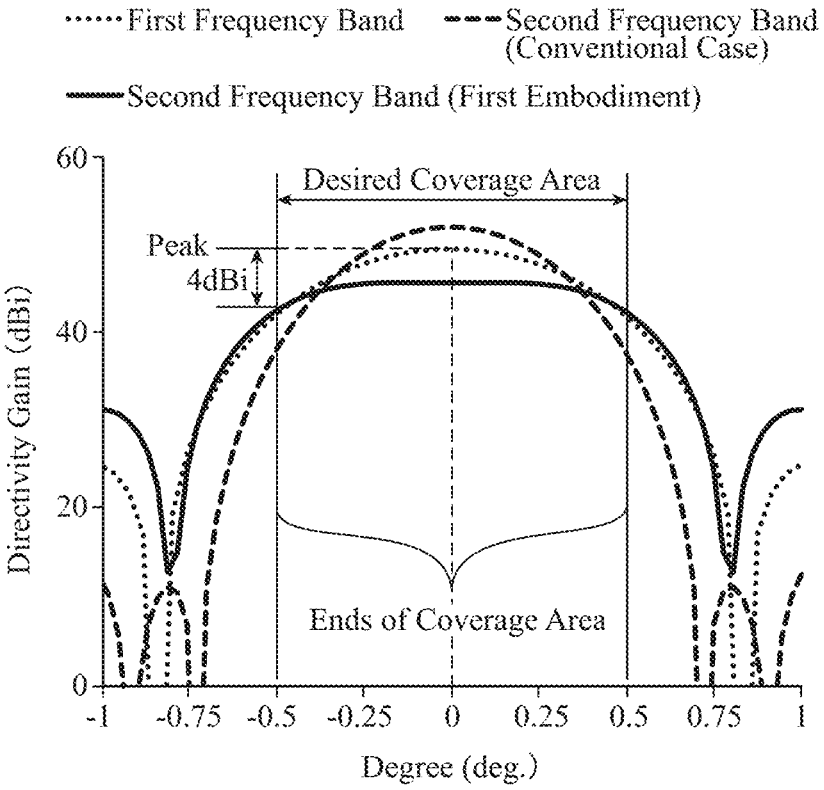
FIG. 4 is an explanatory diagram illustrating a simulation result of beam gain at ends of a coverage area of the reflection mirror antenna device.

FIG. 4 is an explanatory diagram illustrating a simulation result of beam gain at ends of the coverage area of the reflection mirror antenna device.

In the example of FIG. 4, the opening diameter of the reflection mirror 2 is set at 1500 mm, the first frequency band, which is a transmission band, is set at 20 GHz, and the second frequency band, which is a reception band, is set at 30 GHz.

In addition, in the example of FIG. 4, the diameter of the first region 4 in the reflection mirror 2 is set at 1000 mm, and the phase difference between the reflection phase of a radio wave at the center point 3 of the first region 4 and the reflection phase of a radio wave on the second region is set at 180 degrees.

In the example of FIG. 4, an angular range between ends, where dropping from the peak of the directivity gain in the first frequency band (directivity gain in the first frequency band at an angle of 0 degrees) by 4 dBi is exhibited, is defined as the coverage area, and the angular range is shown as one degree (−0.5 to +0.5). The ends of the coverage area in this case are at −0.5 degrees and +0.5 degrees.

Here, the angular range between ends, where the dropping from the peak of the directivity gain by 4 dBi is exhibited, is defined as the coverage area. However, this is merely an example, and angular ranges between ends where the dropping from the peak of the directivity gain by more or less than 4 dBi is exhibited may be defined as the coverage area.

In FIG. 4, a dotted line represents a beam in the first frequency band, a solid line represents a beam in the second frequency band in the first embodiment, and a dashed line represents a beam in the second frequency band in a case where the entire reflection mirror 2 is formed of a conductor (in FIG. 4, this case is expressed as a conventional case).

As illustrated in FIG. 4, the beam in the second frequency band in the case where the entire reflection mirror 2 is formed of a conductor has a beam width narrower than that of the beam in the first frequency band, so that the gain of the beam in the first frequency band at the ends of the coverage area is different from that in the second frequency band.

That is, the gain of the beam in the second frequency band, which is the reception band at the ends of the coverage area, is lower than that in the first frequency band, which is the transmission band.

As illustrated in FIG. 4, in the reflection mirror antenna device of the first embodiment, the beam width of a beam in the first frequency band is substantially the same as that in the second frequency band, and the gain of the beam in the first frequency band at the ends of the coverage area coincides with the gain of the beam in the second frequency band.

Figure 5:
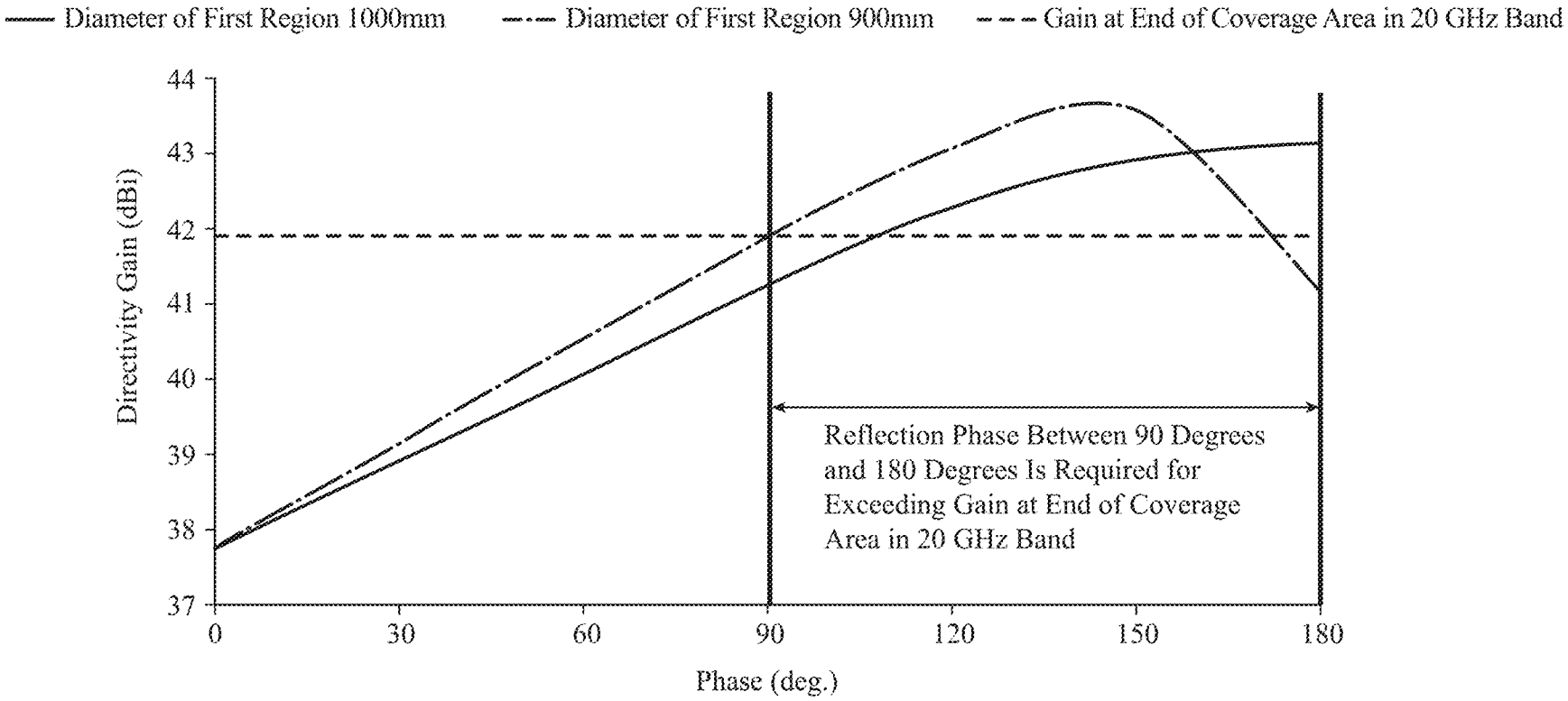
FIG. 5 is an explanatory diagram illustrating a simulation result of beam gain at ends of the coverage area when the reflection phase of the second region is changed from 0 to 180 degrees in each case where a first region 4 has the diameter of 1000 mm and where the first region 4 has the diameter of 900 mm.

FIG. 5 is an explanatory diagram illustrating a simulation result of beam gain at the ends of the coverage area when the reflection phase of the second region is changed from 0 to 180 degrees in each of the cases where the first region 4 has the diameter of 1000 mm and where the first region 4 has the diameter of 900 mm.

In FIG. 5, gain at the ends of the coverage area of 20 GHz means gain of a beam in the first frequency band, which is the transmission band, at the ends of the coverage area, and the gain of the beam is approximately 42 dBi.

It can be seen that, in the range where the phase difference between the reflection phase of a radio wave at the center point 3 of the first region 4 and the reflection phase of a radio wave on the second region is between 90 and approximately 170 degrees, when the first region 4 has the diameter of 900 mm, the gain of the beam in the second frequency band, which is the reception band, at the ends of the coverage area is larger than that in the first frequency band, which is the transmission band.

Further, it can be seen that, in the range where the phase difference between the reflection phases is between approximately 110 and 180 degrees, when the first region 4 has the diameter of 1000 mm, the gain of the beam in the second frequency band, which is the reception band, at the ends of the coverage area is larger than that in the first frequency band, which is the transmission band.

By increasing power of the beam in the first frequency band radiated from the primary radiator 1, it is possible to increase the gain of the beam in the first frequency band, which is the transmission band. Therefore, an effect is achieved in which the gain of the beam in the transmission band and the gain of the beam in the reception band at the ends of the coverage area can be adjusted to coincide with each other.

As understood from the above, a first region 4 of the reflection mirror 2 including a center point 3 of the paraboloid of revolution 2*a* is formed of a conductor 11. A second region 5, which is an outer peripheral side of the first region 4, of the reflection mirror 2 is a region where a plurality of reflection elements 14, which are conductor patterns, is arranged on a dielectric body 13 overlaid on a base plate conductor 12. An arrangement pitch of the plurality of reflection elements 14 corresponds to a wavelength of a radio wave in the second frequency band. As a result, an effect can be achieved in which gain of a beam in a transmission band and gain of a beam in a reception band at ends of a coverage area can be adjusted to coincide with each other without forming a step on the mirror surface of the reflection mirror 2.

In this first embodiment, an example is illustrated in which the N reflection elements 14 arranged in the second region 5 cause delay of the reflection phase of a radio wave on the second region 5 in the range between 90 and 180 degrees compared to the reflection phase of a radio wave at the center point 3 included in the first region 4.

In this embodiment, the reflection phase of a radio wave on the second region 5 is different from that at the center point 3 included in the first region 4 in the range between 90 and 180 degrees. If this condition is satisfied, the configuration is not limited to the above-described example.

Figure 6:
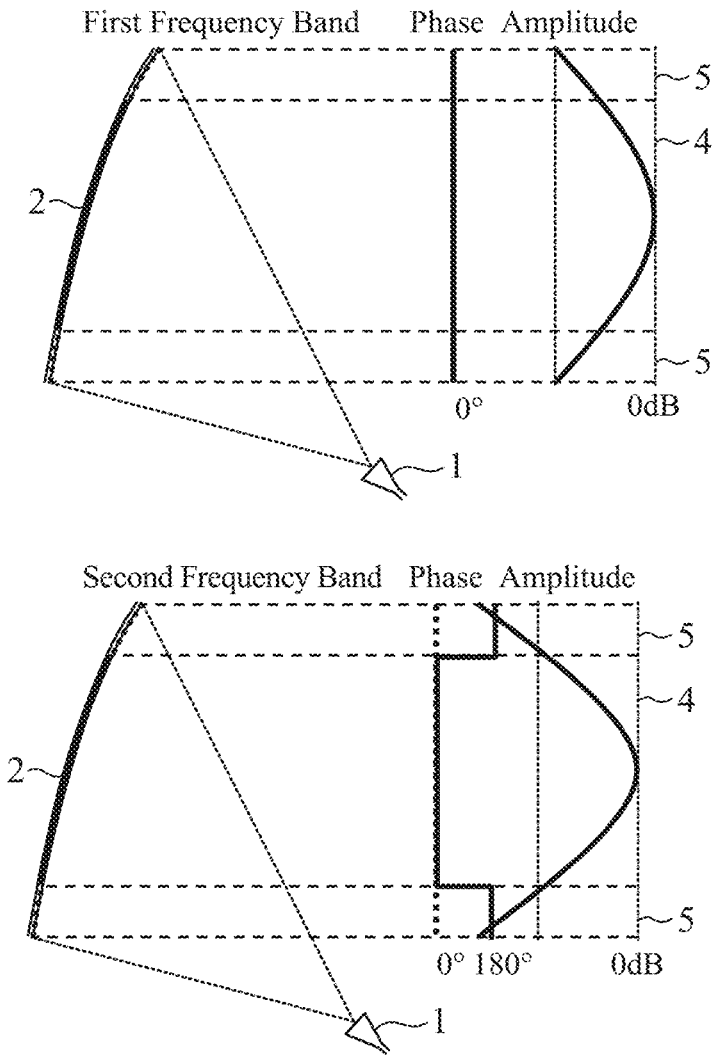
FIG. 6 is an explanatory diagram illustrating the amplitude distribution and the phase distribution on a reflection mirror in another reflection mirror antenna device according to the first embodiment of the invention.

Therefore, as illustrated in FIG. 6, the reflection phase of a radio wave on the second region 5 may be advanced with respect to that at the center point 3 included in the first region 4 in the range between 90 and 180 degrees.

FIG. 6 is an explanatory diagram illustrating amplitude distribution and phase distribution on a reflection mirror in another reflection mirror antenna device according to the first embodiment of the invention.

Second Embodiment

The N reflection elements 14 arranged in the second region 5 may have any shape. In the second embodiment, an example in which each of the reflection elements 14 has a circular ring shape will be illustrated.

Figure 7:
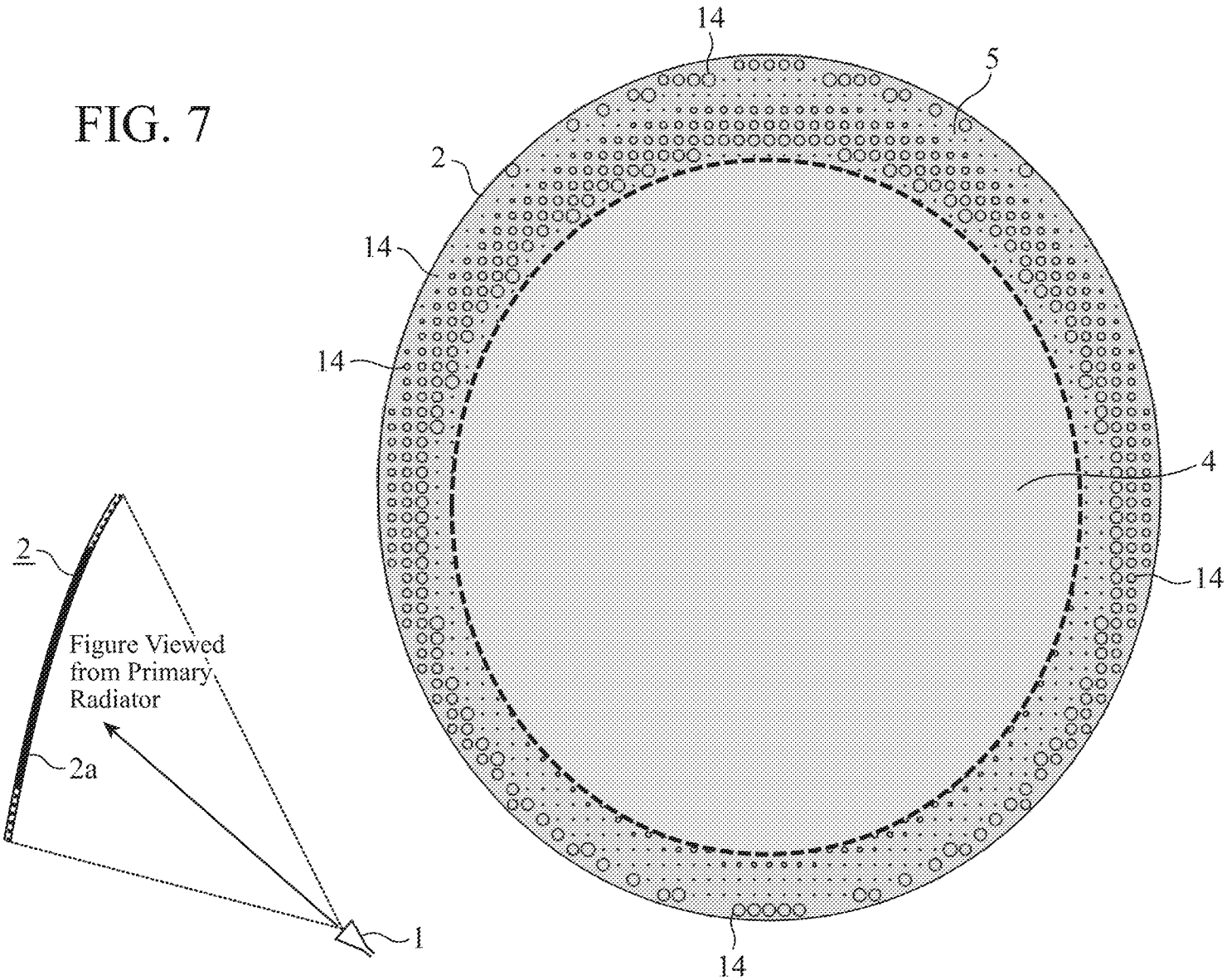
FIG. 7 is a configuration diagram illustrating a reflection mirror antenna device according to a second embodiment of the invention.

FIG. 7 is a configuration diagram illustrating a reflection mirror antenna device according to the second embodiment of the present invention.

Each of the N reflection elements 14 of the reflection mirror antenna device in FIG. 7 has the circular ring shape.

Also in the second embodiment, similarly to the above-described first embodiment, an effect can be achieved in which gain of a beam in a transmission band and gain of a beam in a reception band at ends of a coverage area can be adjusted to coincide with each other without forming a step on the mirror surface of the reflection mirror 2.

Third Embodiment

The N reflection elements 14 arranged in the second region 5 may have any shape. In the third embodiment, an example in which each of the reflection elements 14 has a rectangular ring shape will be illustrated.

Figure 8:
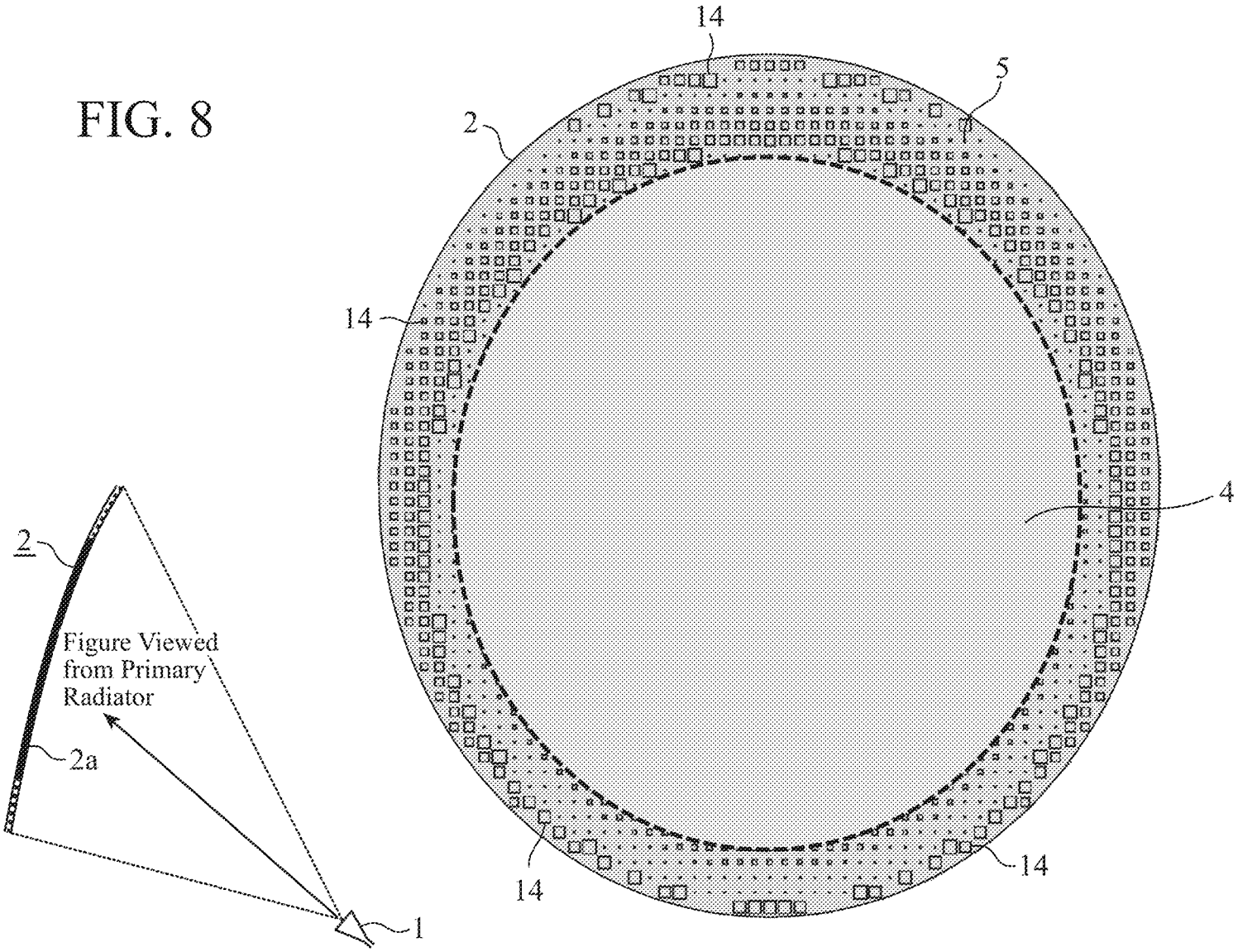
FIG. 8 is a configuration diagram illustrating a reflection mirror antenna device according to a third embodiment of the invention.

FIG. 8 is a configuration diagram illustrating a reflection mirror antenna device according to the third embodiment of the present invention.

Each of the N reflection elements 14 of the reflection mirror antenna device in FIG. 8 has the rectangular ring shape.

Also in the third embodiment, similarly to the above-described first embodiment, an effect can be achieved in which gain of a beam in a transmission band and gain of a beam in a reception band at ends of a coverage area can be adjusted to coincide with each other without forming a step on the mirror surface of the reflection mirror 2.

The reflection elements 14 having the rectangular ring shape can change the reflection phase more easily than those having the circular ring shape.

Fourth Embodiment

In the above-described example of the first embodiment, a reflection mirror antenna device includes one primary radiator 1. In the fourth embodiment, an example of a reflection mirror antenna device including a plurality of primary radiators 1 will be described.

Figure 9:
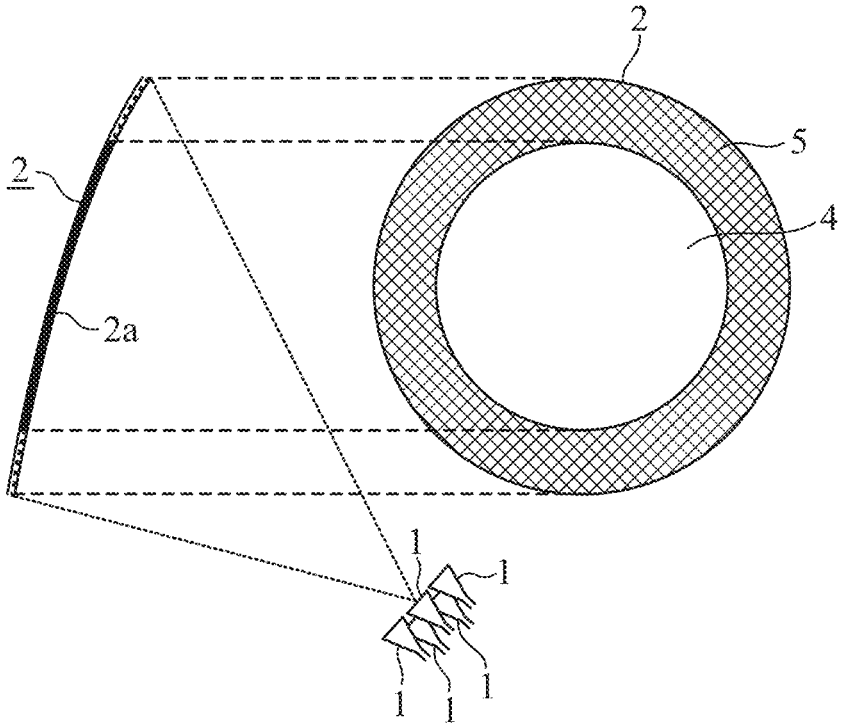
FIG. 9 is a configuration diagram illustrating a reflection mirror antenna device according to a fourth embodiment of the invention.

FIG. 9 is a configuration diagram illustrating the reflection mirror antenna device according to the fourth embodiment of the present invention.

In the example of FIG. 9, the reflection mirror antenna device includes the plurality of primary radiators 1 having a phase center at the origin O, and the reflection mirror 2 has a paraboloid of revolution 2*a* reflecting radio waves radiated from the plurality of primary radiators 1.

This configuration enables the reflection mirror antenna device to be operated as a multi-beam antenna.

It should be noted that, within the scope of the present invention, the embodiments can be freely combined to each other, any components of the embodiments can be modified, and any components of the embodiments can be omitted.

INDUSTRIAL APPLICABILITY

The invention is suitable for a reflection mirror antenna device having a primary radiator and a reflection mirror.

REFERENCE SIGNS LIST

1 Primary radiator
2 Reflection mirror
2*a* Paraboloid of revolution
3 Center point
4 First region
5 Second region
11 Conductor
12 Base plate conductor
13 Dielectric body
14 Reflection element.

The invention claimed is:

1. A reflection mirror antenna device comprising:

at least one primary radiator radiating a radio wave in a first frequency band and a radio wave in a second frequency band higher than the first frequency band; and a reflection mirror having a surface of a paraboloid of revolution reflecting radio waves in the first and second frequency bands radiated from the at least one primary radiator, wherein a first region of the reflection mirror including a center point of the paraboloid of revolution is formed of a conductor, a second region, which is an outer peripheral side of the first region, of the reflection mirror is a region where a plurality of reflection elements, which are conductor patterns, is arranged on a dielectric body overlaid on a base plate conductor, an arrangement pitch of the plurality of reflection elements corresponds to a wavelength of a radio wave in the second frequency band, the plurality of reflection elements arranged in the second region cause phase difference between a reflection phase of a radio wave on the first region and a reflection phase of a radio wave on the second region, and the phase difference between a reflection phase of a radio wave at the center point included in the first region and a reflection phase of a radio wave on the second region is in a range between 90 and 180 degrees.

2. The reflection mirror antenna device according to claim 1, wherein each of the plurality of reflection elements has a circular ring shape.

3. The reflection mirror antenna device according to claim 1, wherein each of the plurality of reflection elements has a rectangular ring shape.

4. The reflection mirror antenna device according to claim 1, wherein the at least one primary radiator comprises a plurality of primary radiators, wherein the reflection mirror has the surface of the paraboloid of revolution reflecting radio waves radiated from the plurality of primary radiators, respectively.

* * * * *